US010029760B2

(12) United States Patent
Muehlner et al.

(10) Patent No.: US 10,029,760 B2
(45) Date of Patent: Jul. 24, 2018

(54) LOW HEAVE SEMI-SUBMERSIBLE OFFSHORE STRUCTURE

(71) Applicant: FloaTEC LLC, Houston, TX (US)

(72) Inventors: Edmund Otto Muehlner, Houston, TX (US); Surya P. Banumurthy, Houston, TX (US)

(73) Assignee: KEPPEL FLOATEC, LLC, Houston, TX (US)

( * ) Notice: Subject to any disclaimer, the term of this patent is extended or adjusted under 35 U.S.C. 154(b) by 0 days.

(21) Appl. No.: 15/148,745

(22) Filed: May 6, 2016

(65) Prior Publication Data

US 2016/0251059 A1 Sep. 1, 2016

Related U.S. Application Data

(63) Continuation of application No. 14/254,987, filed on Apr. 17, 2014, now abandoned.

(51) Int. Cl.

| | |
|---|---|
| ***B65D 88/78*** | (2006.01) |
| ***B63B 35/44*** | (2006.01) |
| ***B63B 1/10*** | (2006.01) |
| *B63B 1/12* | (2006.01) |
| *B63B 39/06* | (2006.01) |

(52) U.S. Cl.

CPC ..... *B63B 1/107* (2013.01); *B63B 35/44* (2013.01); *B63B 35/4413* (2013.01); *B63B 2001/126* (2013.01); *B63B 2001/128* (2013.01); *B63B 2035/448* (2013.01); *B63B 2039/067* (2013.01)

(58) Field of Classification Search

CPC . B63B 35/34; B63B 2035/00; B63B 2035/44; B63B 2035/448; B63B 35/00; B63B 35/44; B63B 2035/442; B63B 35/4413; B63B 35/4486

USPC ..... 114/264–267, 256

See application file for complete search history.

(56) References Cited

U.S. PATENT DOCUMENTS 3,391,666 A * 7/1968 Schuller, Jr. ..... B63B 35/4413 114/122
3,490,406 A * 1/1970 O'Reilly ..... B63B 1/107 114/265
3,949,693 A * 4/1976 Bauer ..... B63B 35/4413 114/124

(Continued)

FOREIGN PATENT DOCUMENTS

CN 1857961 A 11/2006
CN 201347195 Y 11/2009

(Continued)

OTHER PUBLICATIONS

Chinese Office Action dated Sep. 30, 2016 for Application No. 201510157452.5.

(Continued)

*Primary Examiner* — Daniel V Venne

(74) *Attorney, Agent, or Firm* — Patterson + Sheridan, LLP

(57) ABSTRACT

A semi-submersible structure with buoyant vertical columns and a buoyant pontoon. Unlike the typical semi-submersible where the pontoons are attached directly between the columns, the pontoon of the invention encircles the columns and is arranged outside of the columns. The pontoon encircling the columns simplifies construction and attachment of the pontoon and columns and improves the heave characteristics of the structure.

14 Claims, 11 Drawing Sheets

(56) References Cited

U.S. PATENT DOCUMENTS

| | | | | |
|---|---|---|---|---|
| 4,356,789 | A * | 11/1982 | Hammett | B63B 35/44 114/264 |
| 4,436,050 | A * | 3/1984 | Liden | B63B 35/4413 114/265 |
| H000611 | H * | 4/1989 | Peace | B63B 35/4413 114/125 |
| 6,015,245 | A * | 1/2000 | Frimm | B63B 35/4413 114/256 |
| 6,652,192 | B1 | 11/2003 | Xu et al. | |
| 7,140,317 | B2 | 11/2006 | Wybro et al. | |
| 7,281,881 | B1 | 10/2007 | Cermelli et al. | |
| 7,891,909 | B2 | 2/2011 | Tahar et al. | |
| 8,267,032 | B2 | 9/2012 | Zou | |
| 2003/0017009 | A1 | 1/2003 | Matsuura et al. | |
| 2004/0182297 | A1* | 9/2004 | Wybro | E21B 19/004 114/230.1 |
| 2006/0260526 | A1 | 11/2006 | Kristensen et al. | |
| 2009/0279958 | A1* | 11/2009 | Heidari | B63B 35/44 405/223.1 |
| 2010/0024705 | A1* | 2/2010 | Leverette | B63B 35/4413 114/264 |
| 2011/0126750 | A1* | 6/2011 | Leverette | B63B 35/4413 114/265 |
| 2012/0111256 | A1 | 5/2012 | Xu | |
| 2013/0032076 | A1 | 2/2013 | Zeng et al. | |
| 2013/0319314 | A1 | 12/2013 | Wang et al. | |

FOREIGN PATENT DOCUMENTS

| | | | |
|---|---|---|---|
| CN | 101918270 | A | 12/2010 |
| CN | 202966606 | U | 6/2013 |

OTHER PUBLICATIONS

Korean Office Action dated Aug. 30, 2017 for Application No. 10-2015-31738.

Chinese Office Action dated Feb. 5, 2018 for Application No. 201510157452.5.

* cited by examiner

LOW HEAVE SEMI-SUBMERSIBLE OFFSHORE STRUCTURE

CROSS-REFERENCE TO RELATED APPLICATIONS

This application is a continuation of now abandoned, U.S. patent application Ser. No. 14/254,987, filed Apr. 17, 2014, which is herein incorporated by reference.

FIELD AND BACKGROUND OF INVENTION

The invention is generally directed to offshore floating structures used in the production of oil and natural gas and particularly to semi-submersible structures.

There are a variety of floating structures used in the production of oil and gas in deeper water offshore. Each type of structure has its own advantages and disadvantages relative to motion characteristics that may make it more or less suitable for use in certain wave conditions.

The semi-submersible is a type of floating structure that has vertical columns supporting topsides, with the columns being supported on large pontoons that extend between the columns as seen in FIGS. 14A and 14B. The structure typically is held in position by the use of spread mooring lines that are anchored to the seafloor. The semi-submersible has a number of unique characteristics compared with other floating structures such as a Spar and TLP (tension leg platform).

Conventional semi-submersible structures provide general advantages that include: the semi-submersible has good stability because of a large foot-print and low center of gravity. The hull requires lower steel tonnage. The semi-submersible may include drilling capability. The semi-submersible can support a large number of flexible risers or SCRs (steel catenary risers) because of the space available on the pontoons. The topsides can be integrated at quayside and thus reduce cost and save scheduling time. The semi-submersible has a relatively short to medium development schedule and the initial investment is relatively low. The semi-submersible can also be held at a relative shallow draft during launch and fit up work, which means that it is capable of being launched or worked upon at quayside adjacent most construction yards worldwide. The semi-submersible provides a larger payload capacity than Spars and can operate in deeper water than TLPs. Semi-submersibles allow quayside integration and are simpler to install than both Spars and TLPs.

The semi-submersible also has several deficiencies. The most significant is that rougher water created by storms can cause large heave (vertical) motions. As a result, semisubmersibles have not been suitable for a dry tree riser arrangement. A dry tree riser arrangement has the well controls (referred to in the industry as the "tree" or "Christmas Tree") above the water line on the vessel. The flow connection between the seabed and the dry tree is provided by a vertical top-tension riser (TIR). The dry tree riser arrangement has significant economic benefit for well completion, work-over, and intervention during the life of the offshore production facility. The dry tree riser also offers the operational advantages of flow assurance, well access, drilling, etc., which is not possible with wet tree units.

The offshore industry has been attempting to develop a successful arrangement for a dry tree semi-submersible as an alternative to Spars and TLPs for more than a decade. That effort has been unsuccessful so far. Another problem from the large heave motion is that it causes fatigue in SCRs more easily, which requires more stringent fatigue design for the SCRs and thus costs more. For a platform with large diameter SCRs, the solutions to this problem could become technically or economically unfeasible.

The ideas that have been explored by the industry to achieve low motion characteristics of semi-submersibles generally fall into the categories below.

The first is a deep draft semi-submersible. The concept is to increase the draft from the normal range from sixty to eighty feet to greater than one hundred feet so that the wave action at the keel is reduced and, thus, the structure will have less motion. This makes the semi-submersible option feasible in some locations where the conventional semi-submersible would not be chosen because of the difficulties in dealing with the SCR riser fatigue issues. However, the heave motion is still relatively large compared with spars and TLPs. Also, the dry tree arrangement is still not feasible.

The second is a semi-submersible with one or more heave plates 48 situated below the hull. This is illustrated in FIG. 13. The basic idea is to add a heave plate or pontoon at the keel that extends in deep draft. The heave plate or pontoon adds damping and added mass to the platform which will reduce its heave motion under wave conditions.

Most concepts based on the heave plate have the heave plate or pontoon as an extendable part attached to the bottom of the semi-submersible hull by means of columns or a truss structure. The heave plate or pontoon is retracted at the fabrication yard and during transportation. After the hull is located on the site, the heave plate or pontoon is then extended or lowered to a deeper elevation and locked at that position.

The known designs suffer several deficiencies. The extendible columns take too much deck space. In some cases it could be as much as thirty percent of the total deck space, which is impractical from a topsides equipment layout point of view. The structural connections and locking mechanisms of extendible columns are complicated. They are hard to build, risky during installation, and difficult to maintain, On the other hand, designs with rigidly attached heave plates have a much greater draft than a conventional semi-submersible and cannot be readily brought quayside.

The desired features of an alternative to the Spar and TLP are: 1) motion characteristics compatible with TTRs, 2) low cost, 3) ability to operate in water depths exceeding 8,000 feet, 4) large deck area, 5) high payload capacity, and 6) quay-side integration/commissioning.

The challenge for semi-submersible structures as dry-tree floaters is their comparatively large heave response in waves. Since dry-tree risers are arranged vertically, the relative motions between vessel and risers must be compensated by riser tensioners. Typical semi-submersible designs have a heave response resulting in a tensioner stroke that exceeds the stroke range of existing riser tensioners. Achieving a heave response compatible with market-ready tensioner technology is therefore crucial for developing a dry-tree semisubmersible.

SUMMARY OF INVENTION

The present invention is drawn to a semi-submersible structure with buoyant vertical columns and a buoyant pontoon. Unlike the typical semi-submersible where the pontoons are attached directly between the columns, the pontoon of the invention encircles the columns and is arranged on the outside of the columns. The pontoon encircling the columns reduces the heave motions of the vessel and provides a simple structural arrangement for construction.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
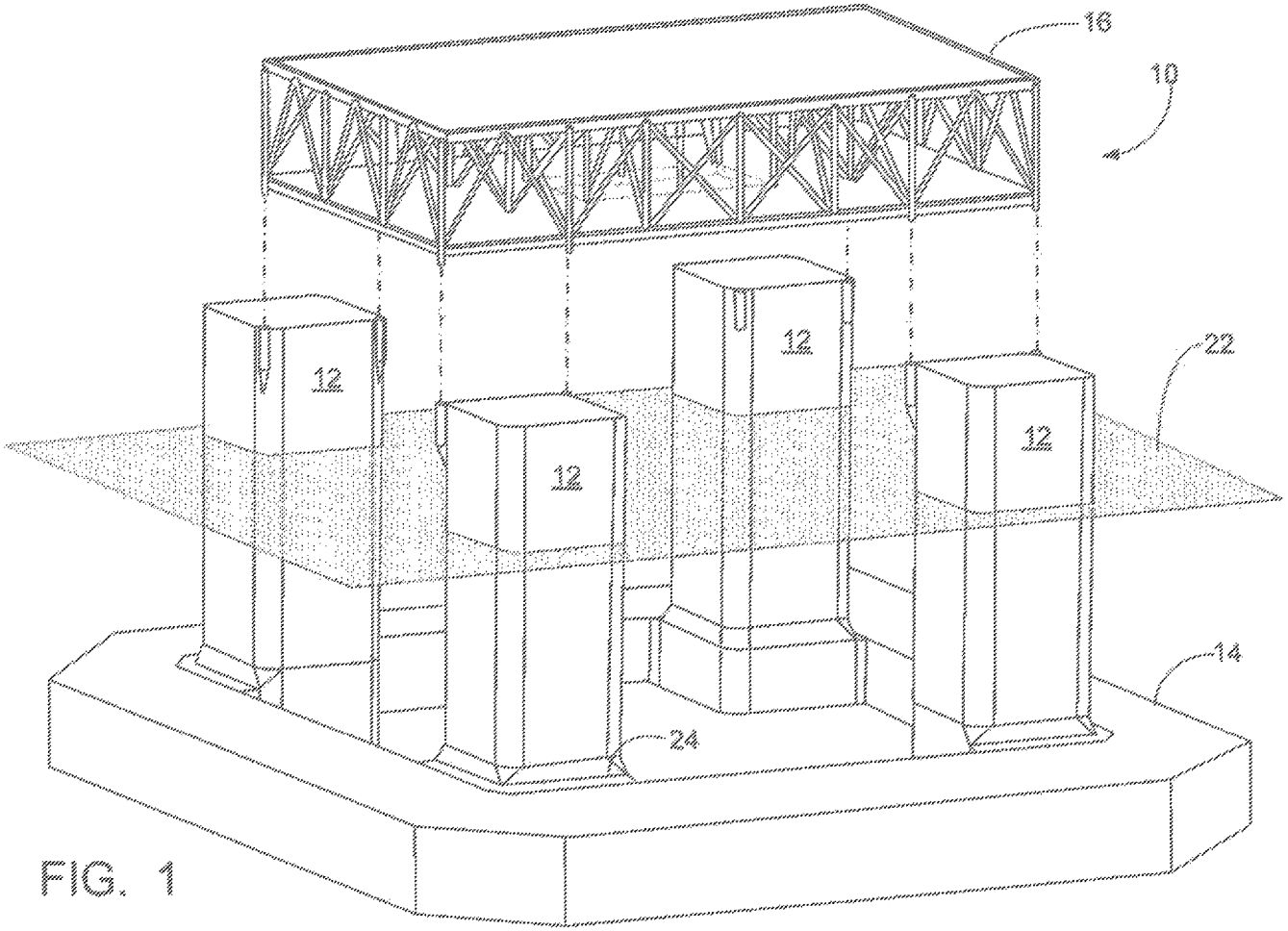
FIG. 1 is perspective view of the semi-submersible structure of the invention with a topside structure.

As seen in FIG. 1, the semi-submersible floating offshore structure 10 of the invention is generally comprised of buoyant vertical columns 12, a buoyant pontoon 14 attached to the columns 12, and a topside 16.

Figure 6:
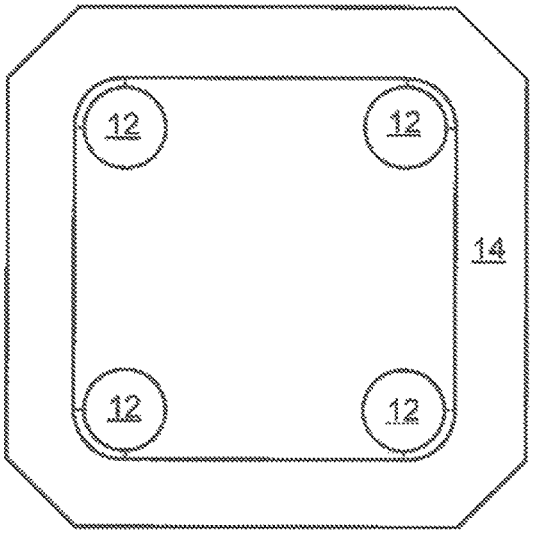
FIG. 6 is a top view of the semi-submersible hull with circular columns.

Vertical columns 12 are sized in proportion to the designed weight of the structure 10 such that they, along with the pontoon 14, provide suitable buoyancy to float the completed structure 10 at the installation and operational site offshore. While the drawings illustrate the use of four columns 12, it should be understood that three, four, or more columns may be used as required for different size structures. FIG. 15 A-D illustrate different numbers, arrangements, and cross sections of columns 12. The columns 12 may be square or rectangular in cross section as seen in FIGS. 1, 2, 3, and 7-10 or they may be circular in cross section as illustrated in FIG. 6. While only rectangular and circular cross sections are shown, it should be understood that other cross sections may also be used.

Figure 3:
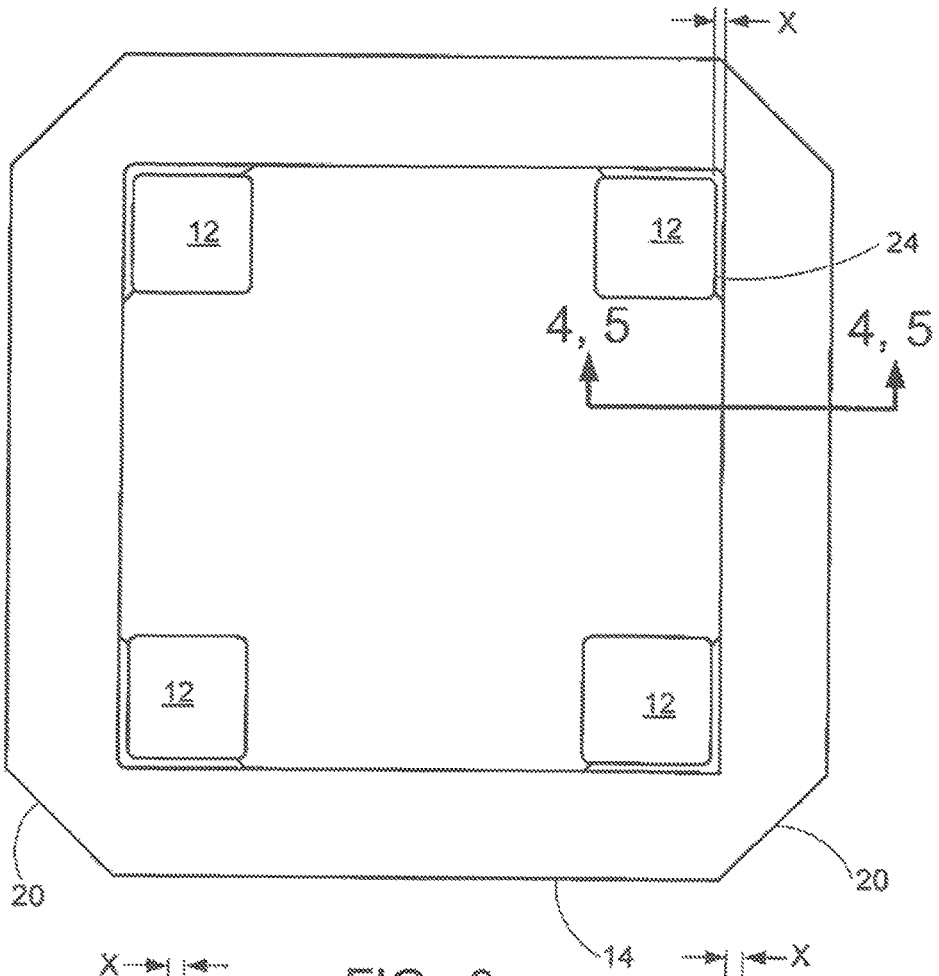
FIG. 3 is a top view of the invention.
Figure 4:
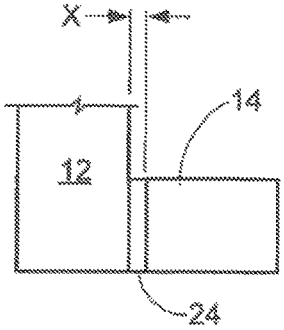
FIGS. 4 and 5 illustrate two examples of pontoon cross sections for the invention.
Figure 5:
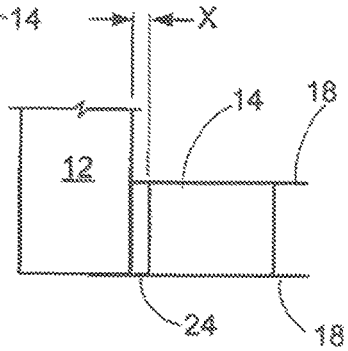
Figure 9:
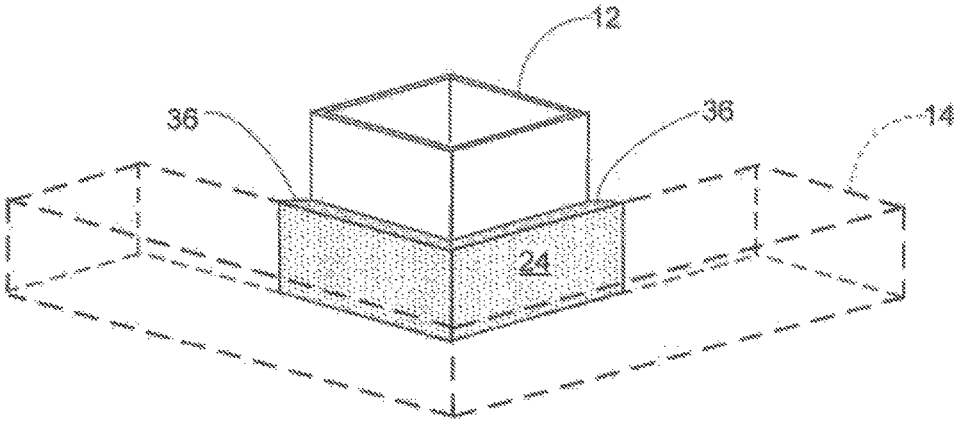
FIGS. 9 and 10 are detail views that illustrate the connection between the column and pontoon.
Figure 10:
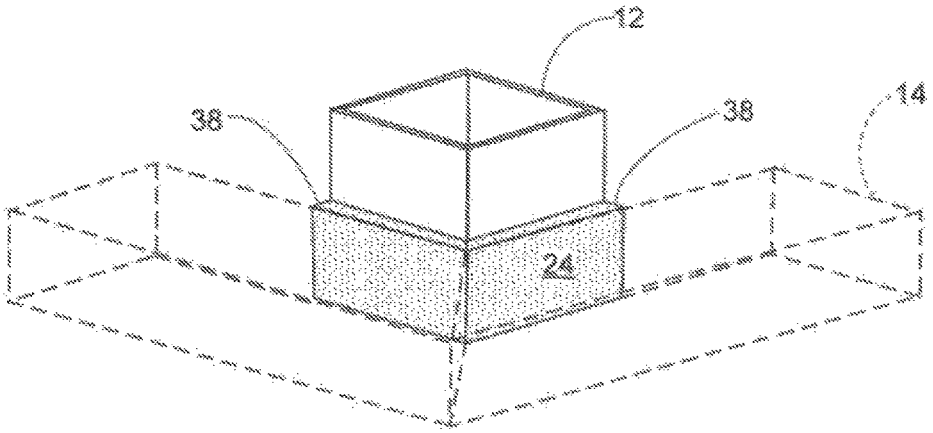

In the preferred embodiment (best seen in FIGS. 1, 2, 3, and 6-10), the pontoon 14 is sized so that the inner perimeter of the pontoon 14 lies on the outside of the outer perimeter of the columns 12 as defined by the structure such that the pontoon 14 does not extend between or inside the columns 12. The pontoon 14 encircles the columns 12 and is offset from the perimeter of the columns 12 by a distance "X" as indicated in FIGS. 3, 4, and 5 such that none of the vertical surfaces of the columns 12 are in the same plane as the vertical surfaces of the pontoon 14. As seen in the detail views of FIGS. 7A, 9, and 10, the offset is achieved by the use of column-to-pontoon connectors 24 to attach the pontoon 14 to the columns 12. The column-to-pontoon connectors 24 may have an angled end 36 as seen in FIG. 9 or a straight end 38 as seen in FIG. 10. Each column-to-pontoon connector 24 is rigidly connected between the column and pontoon by any suitable means such as welding. The use of a separate connector provides the advantage of tailoring the offset between the columns 12 and pontoon 14 to provide the desired motion characteristics of the semi-submersible structure 10.

As seen in FIG. 15 A-D, the outer perimeter of the columns 12 is defined by line 50 and can be considered as the shortest path that surrounds all of the columns 12.

As indicated above, the buoyancy provided by the pontoon 14 is directly related to the size and weight of the structure that must be supported by the buoyant columns 12 and the buoyant pontoon 14. The pontoon 14 and columns 12 may be divided into a plurality of separate buoyancy compartments.

FIGS. 4 and 5 illustrate two examples of pontoon cross sections. FIG. 4 illustrates a pontoon with a rectangular cross section. FIG. 5 illustrates a pontoon with a cross section that includes heave plates 18 that extend outwardly from the upper and lower surfaces of the pontoon 14 away from the structure 10. While the width to height ratio of the pontoon cross section illustrated in FIG. 5 is less than that in FIG. 4, this should not necessarily be taken as being to scale. It should also be understood that, even if the pontoon width to height ratio is smaller as seen in FIG. 5, the heave plates 18 still serve to improve the motion characteristics of the structure 10 by effectively increasing the trapped water mass during heave motions due to environmental forces.

Figure 7:
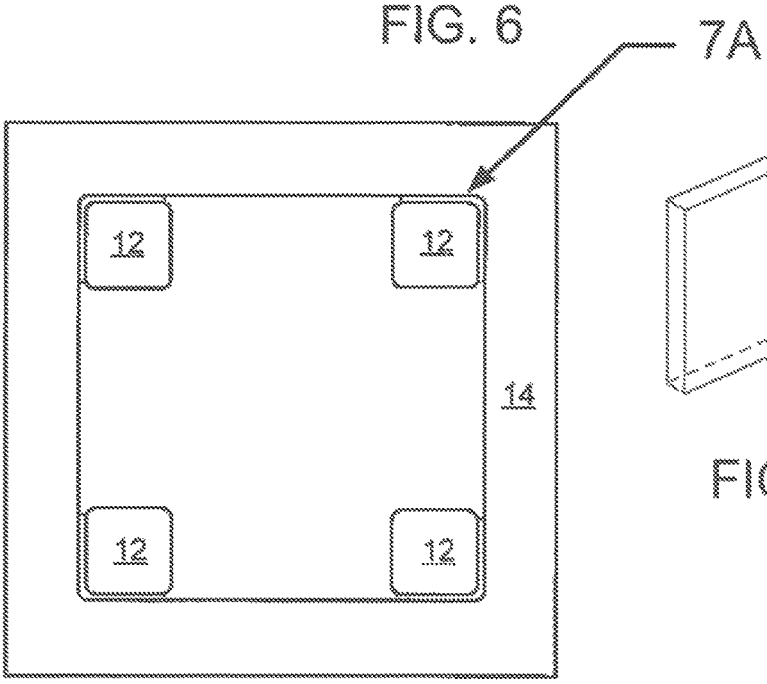
FIG. 7 is a top view of the semi-submersible hull with an alternative pontoon shape.
Figure 7A:
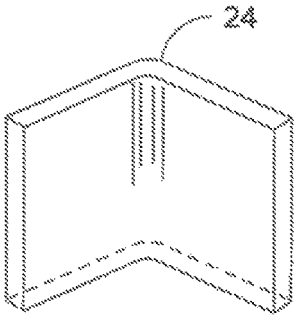
FIG. 7A is a detail view of area 7A indicated in FIG. 7.
Figure 8:
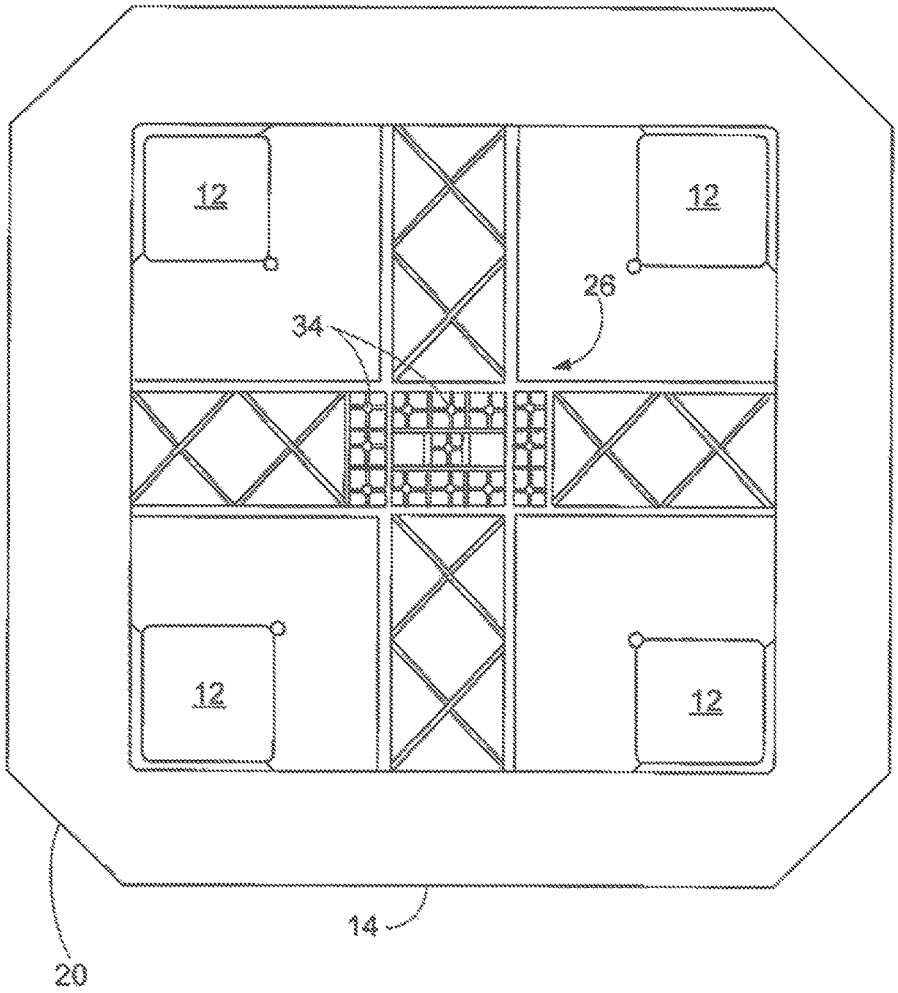
FIG. 8 is a top view of the semi-submersible hull that shows the keel guide structure.

The corners 20 of the pontoon 14 may be beveled as seen in FIGS. 1-3, 6, and 8 or the corners 20 may be at right angles (90 degrees) as seen in FIG. 7.

FIG. 1 illustrates the semi-submersible structure 10 of the invention with a basic topside structure 16 to be installed on and supported by the upper end of the columns 12. The topside 16 is shown above the columns for the sake of clarity in the drawing. The buoyancy of the columns 12 and pontoon 14 support the topside 16 above the water line 22 during offshore drilling and production operations. The topside 16 is used to support living quarters for workers, equipment storage, and drilling and production equipment.

Semi-submersible structures may be temporarily retained in position for short term activities by dynamic positioning using thrusters. However, for long term operations such as drilling and production, the structure is generally held in place by mooring lines attached between the structure 10 and anchors in the sea floor. For the sake of less complex drawings, dynamic positioning equipment, mooring lines, anchors, and attachment of the mooring lines to the structure are not shown since they are well known in the offshore industry.

Figure 2:
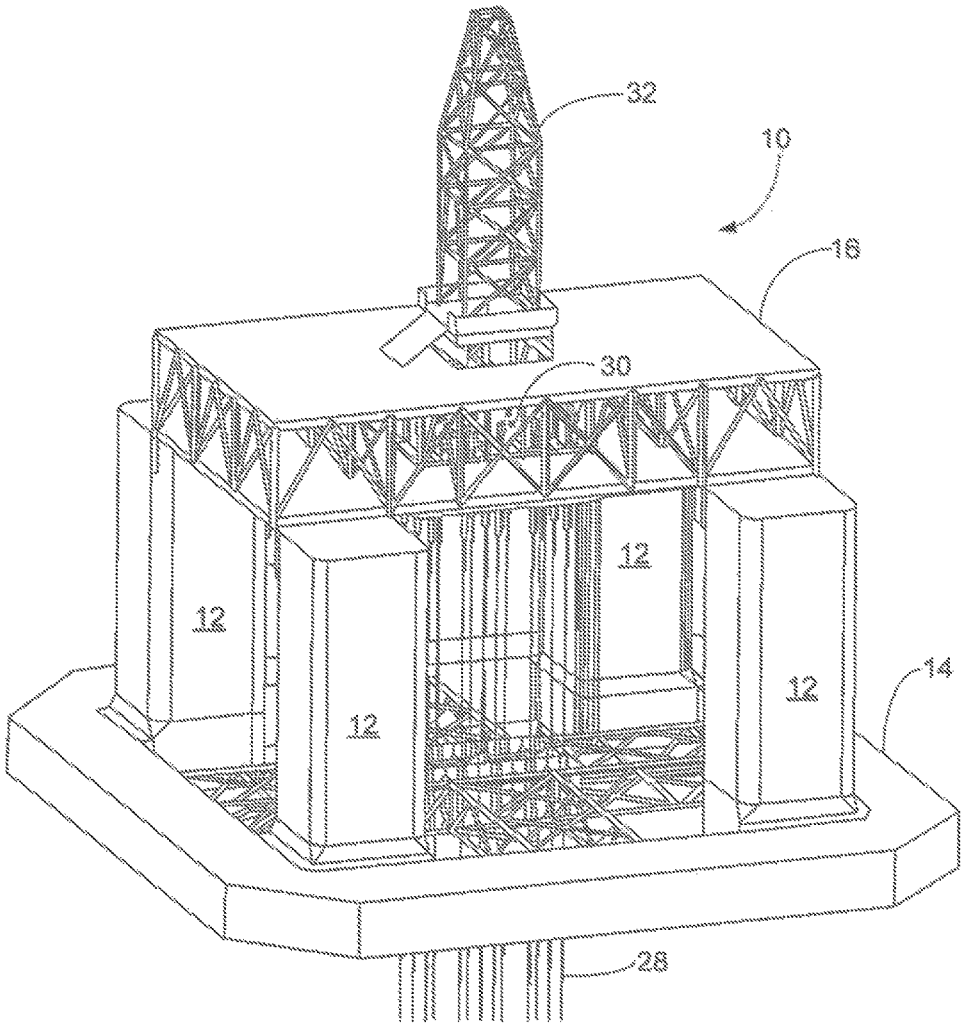
FIG. 2 is a perspective view of the semi-submersible structure of the invention with topside, keel guide structure, and top-tension risers installed.

FIG. 2 illustrates the semi-submersible structure 10 of the invention with the topside 16, a keel guide framework 26 (best seen in FIG. 8), risers 28, and a derrick 32 to support drilling work. The keel guide framework 26 controls the lateral movement of the risers 28. As seen in FIG. 8, the keel guide framework provides individual slots 34 through which the risers 28 pass. While the vessel may support a combination of dry tree and wet tree risers, depending upon the situation, the intent of FIG. 2 is to show dry tree risers as indicated by the riser equipment 30 in the mid-section of the topside 16.

Figure 11:
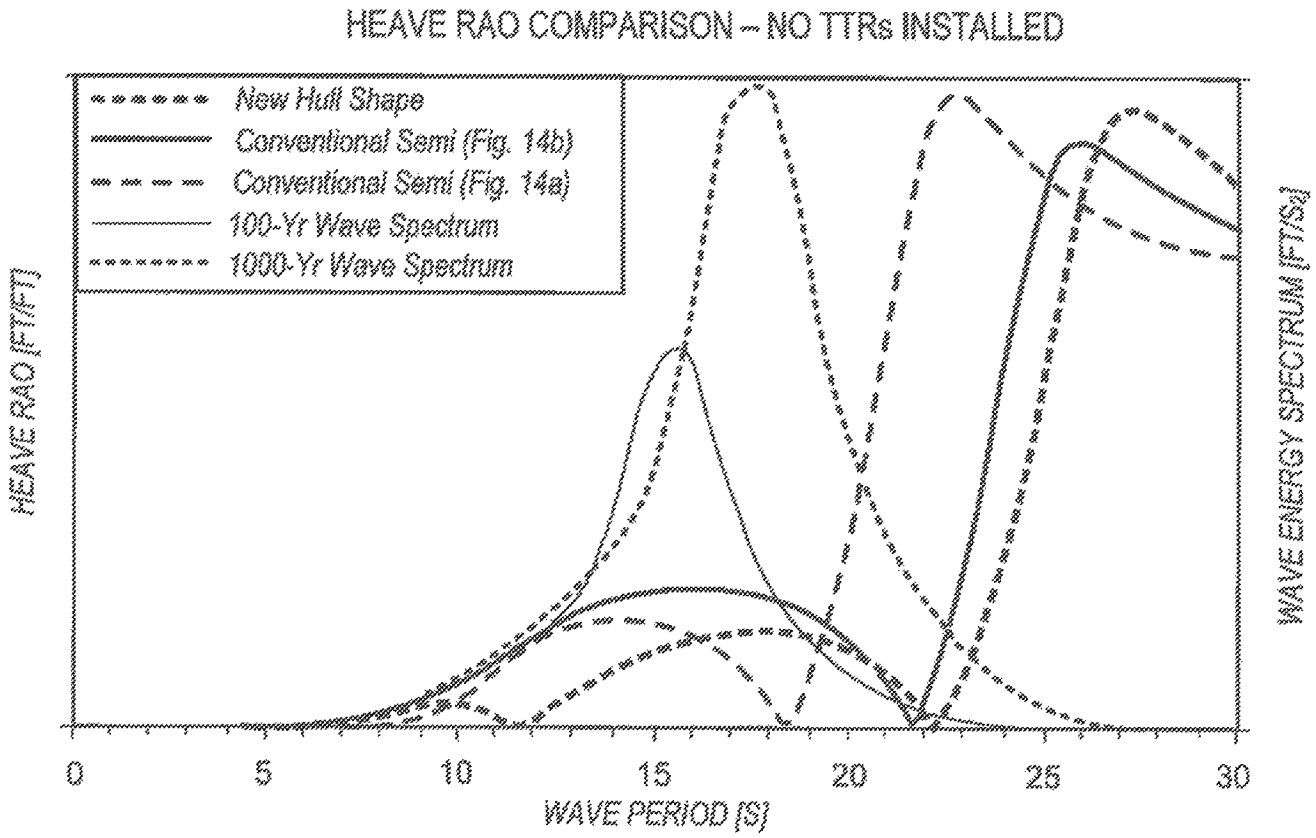
FIGS. 11 and 12 are graphs that provide Heave RAO comparison for structures without and with top tension risers.
Figure 12:
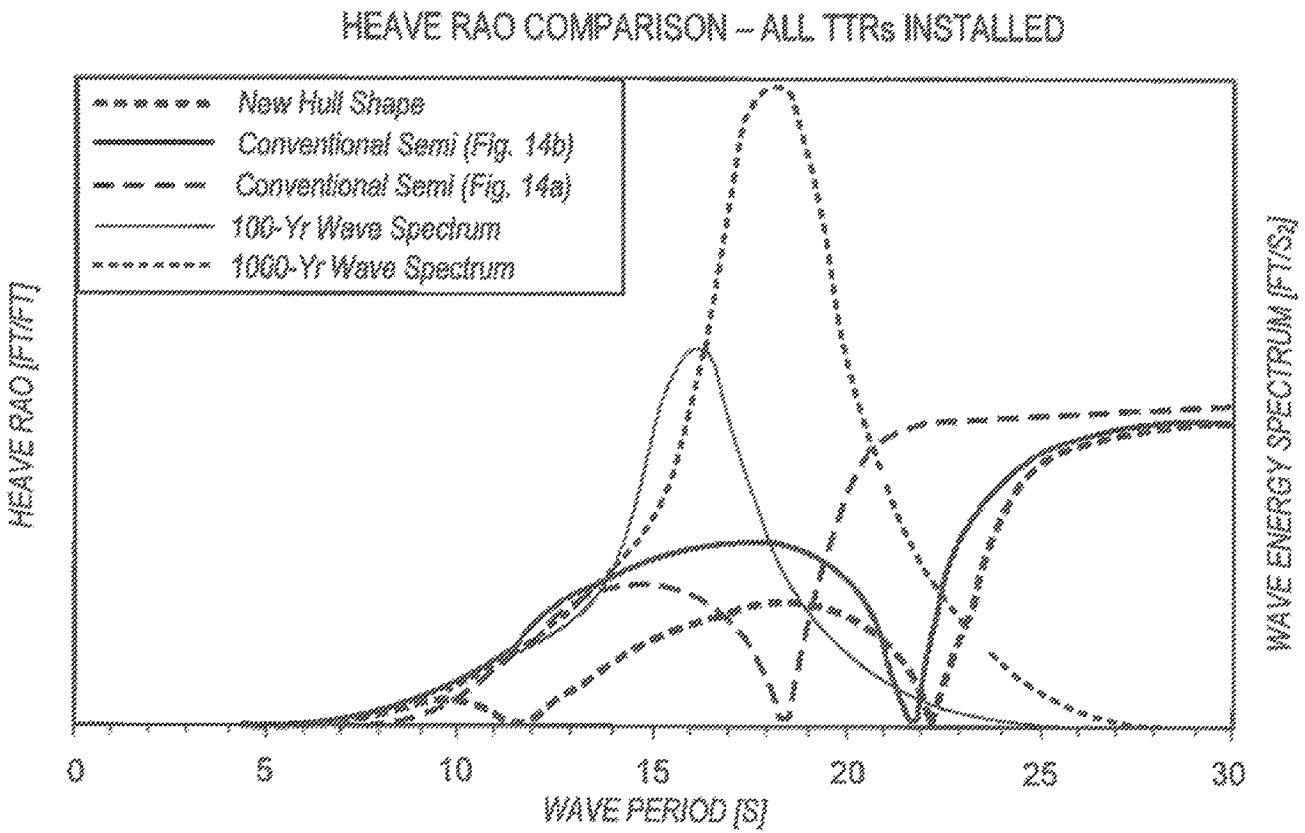
Figure 13:
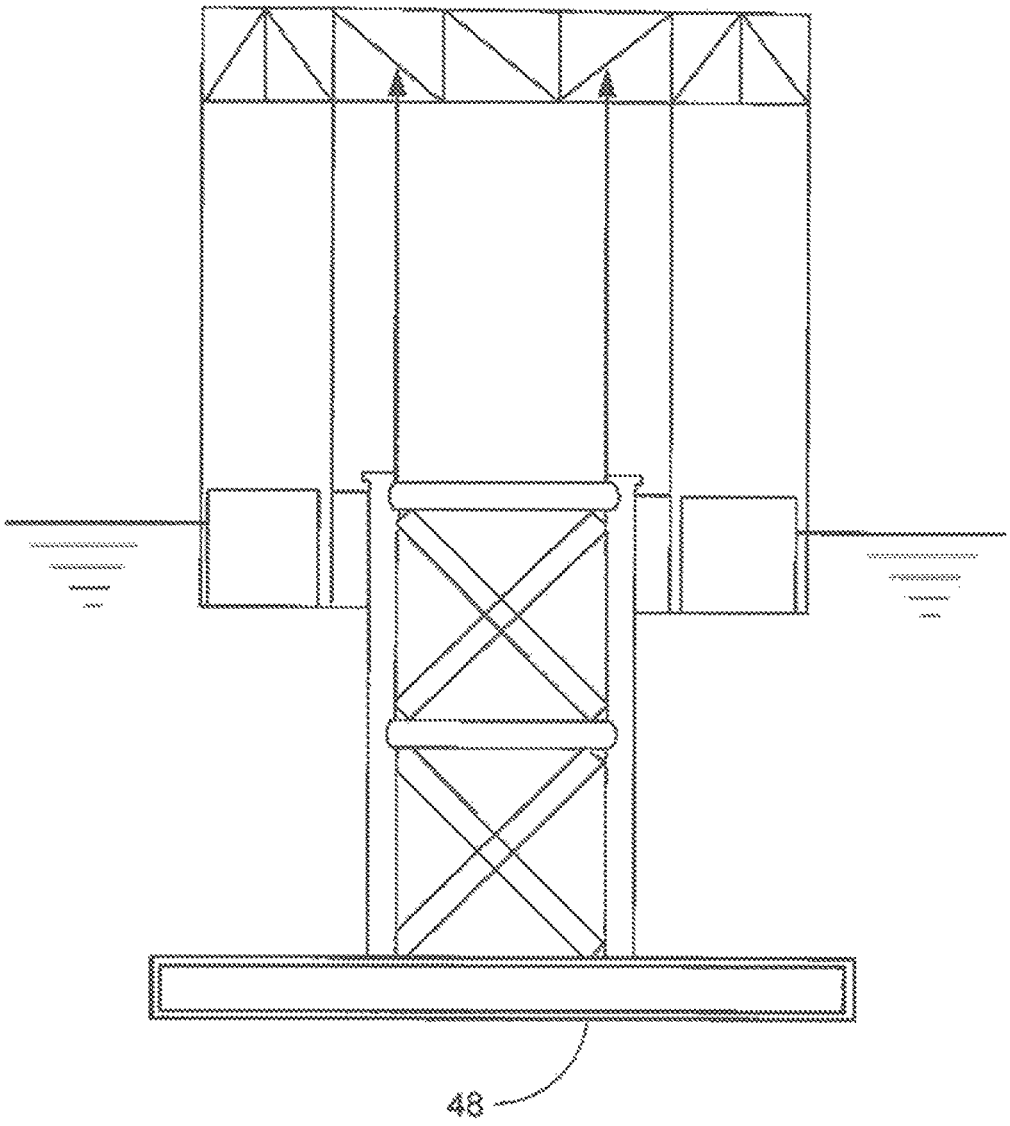
FIG. 13 PRIOR ART
FIGS. 13, 14A, and 14B illustrate prior art semi-submersible structures.
Figure 14A:
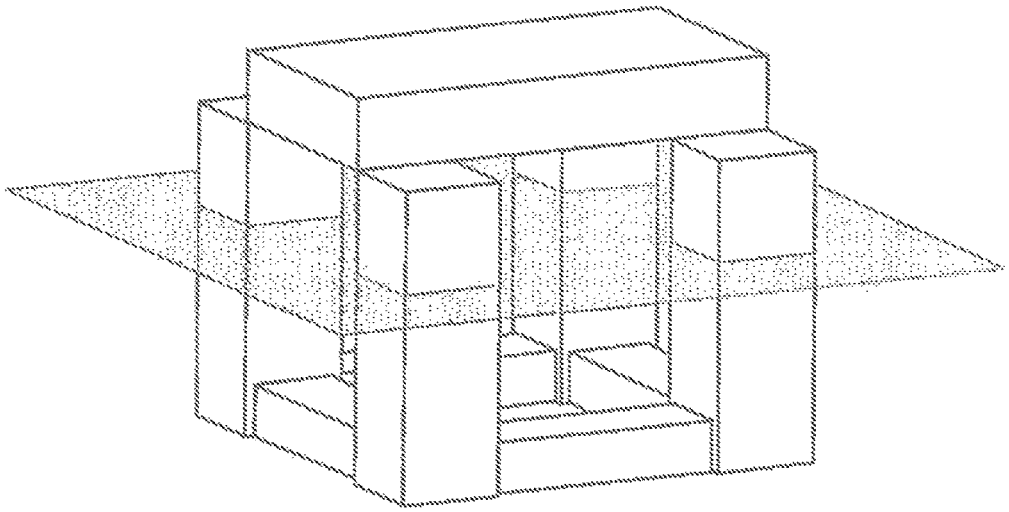
FIG. 14A PRIOR ART

FIGS. 11 and 12 are graphs that provide a heave RAO (response amplitude operator) comparison of a conventional semi-submersible and the invention. FIGS. 11 and 12 show RAOs without and with top tension risers installed, respectively. It can be seen that the invention, indicated by the line of thick, short dashes, provides a more favorable heave RAO than a conventional (prior art) semi-submersible with a pontoon as shown in FIG. 14A. The improvement of the invention is due to the fact that it shifts the characteristic shape of the heave RAO to higher wave periods, i.e. to the right in FIGS. 11 and 12. The heave RAO shift to a higher wave period pushes the high response area of the RAO (i.e. the resonance region) outside the range of high wave energy which reduces the vessel's heave response. The heave reduction of the invention compared to the conventional semi-submersible in FIG. 14A is particularly significant in a 1,000-year wave environment where the vessel heave is typically the largest.

Figure 14B:
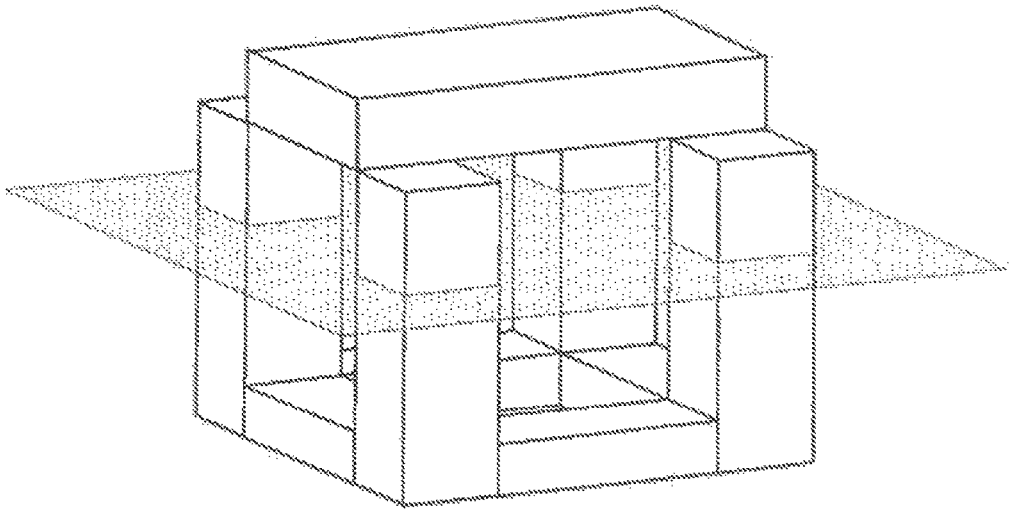
FIG. 14B PRIOR ART
Figure 15B:
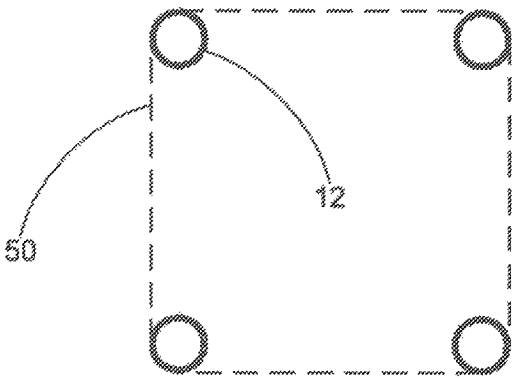
FIG. 15 A-D illustrate different column configurations and the outer perimeter of the columns.
Figure 15A:
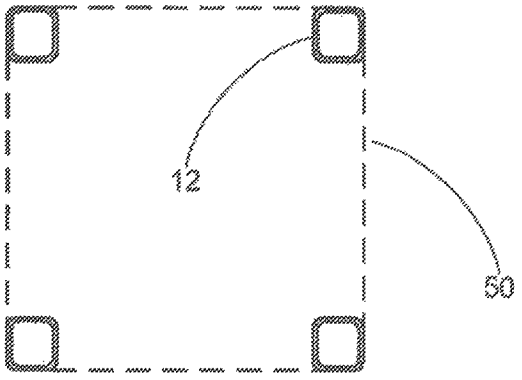
Figure 15D:
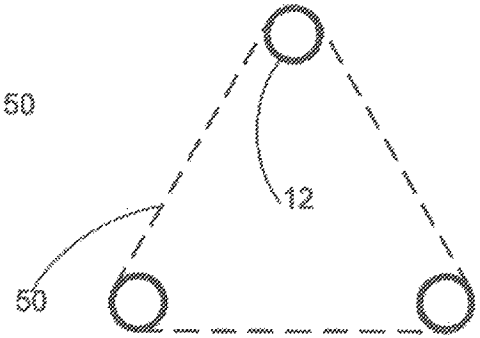
Figure 15C:
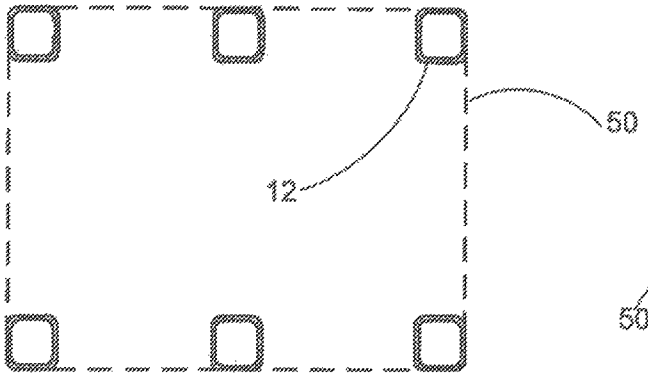

A heave RAO shift to higher wave periods can also be achieved to some extent by increasing the pontoon width of a conventional semi-submersible (prior art), as shown in FIG. 14B. However, the increase of the pontoon width has the adverse effect of increasing the heave RAO in the wave period range of about 10 seconds to 22 seconds and thereby again increasing the overall heave response of the vessel. As it is shown in FIGS. 11 and 12, the invention does both, it shifts the high response region of the RAO (i.e. the resonance region) outside the range of high wave energy and also keeps the heave RAO low in the region of about 10 seconds to 22 seconds.

The invention provides several advantages.

It provides a longer heave natural period than a conventional semi-submersible which reduces the vessel's heave motion in wave environments with long wave periods.

It reduces the vessel's heave response in the wave periods range between 10 seconds and 22 seconds.

The reduction in heave response enables the use of a dry-tree riser arrangement for semi-submersibles.

The reduction in heave response reduces the fatigue of SCRs for wet-tree applications.

The large pontoon provides a small minimum draft, which enables the vessel's quayside integration in yards with shallow quay-side water depth.

The invention provides a floating system for dry-tree risers without the water depth limitation of tension leg platforms (TLPs).

The invention provides a floating system for dry-tree risers without the deck area limitation of Spar platforms.

The invention provides a floating system for dry-tree risers without the payload limitation of Spar platforms.

Versatility—The invention is suitable for a wide range of applications including dry-tree and wet tree production units, as well as for MODUs (mobile offshore drilling units).

While specific embodiments and/or details of the invention have been shown and described above to illustrate the application of the principles of the invention, it is understood that this invention may be embodied as more fully described in the claims or as otherwise known by those skilled in the art (including any and all equivalents), without departing from such principles.

What is claimed as invention is:

1. A semi-submersible floating offshore structure, comprising:

a) a plurality of buoyant columns spaced apart from each other;

b) a buoyant pontoon attached at lower ends of the plurality of buoyant columns by column-to-pontoon connectors, the buoyant pontoon having an inner perimeter encircling the plurality of buoyant columns, the inner perimeter of the buoyant pontoon arranged entirely outside of an outer perimeter of the plurality of buoyant columns; and c) a topside attached to and supported at tops of the plurality of buoyant columns.

2. The semi-submersible floating offshore structure of claim 1, wherein the buoyant pontoon is offset from the plurality of buoyant columns such that none of the vertical surfaces of the plurality of buoyant columns are in the same plane as the vertical surfaces of the buoyant pontoon.

3. The semi-submersible floating offshore structure of claim 1, wherein the cross section of each column of the plurality of buoyant columns is rectangular.

4. The semi-submersible floating offshore structure of claim 1, wherein the cross section of each column of the plurality of buoyant columns is circular.

5. The semi-submersible floating offshore structure of claim 3, further comprising a heave plate that extends horizontally from the buoyant pontoon.

6. The semi-submersible floating offshore structure of claim 1, wherein the corners of the buoyant pontoon are beveled.

7. The semi-submersible floating offshore structure of claim 1, wherein the corners of the buoyant pontoon form a right angle.

8. A semi-submersible floating offshore structure, comprising:

a) a plurality of buoyant columns spaced apart from each other;

b) a buoyant pontoon attached at lower ends of the plurality of buoyant columns by column-to-pontoon connectors, the buoyant pontoon having an inner perimeter encircling the plurality of buoyant columns, the inner perimeter of the buoyant pontoon arranged entirely outside of an outer perimeter of the columns;

c) a heave plate extending horizontally from the buoyant pontoon; and d) a topside attached to and supported at tops of the plurality of columns.

9. The semi-submersible floating offshore structure of claim 8, wherein the buoyant pontoon is offset from the plurality of buoyant columns such that none of the vertical surfaces of the plurality of buoyant columns are in the same plane as the vertical surfaces of the buoyant pontoon.

10. The semi-submersible floating offshore structure of claim 8, wherein the cross section of the plurality of buoyant columns is rectangular.

11. The semi-submersible floating offshore structure of claim 8, wherein the cross section of the plurality of buoyant columns is circular.

12. The semi-submersible floating offshore structure of claim 8, wherein the corners of the buoyant pontoon are beveled.

13. The semi-submersible floating offshore structure of claim 8, wherein the corners of the buoyant pontoon form a right angle.

14. A semi-submersible floating offshore structure, comprising:

a plurality of buoyant columns spaced apart from each other;

a buoyant pontoon coupled to the plurality of columns at lower ends thereof, the buoyant pontoon offset from the plurality of buoyant columns and having an inner perimeter encircling the plurality of buoyant columns, wherein an inner perimeter of the pontoon is arranged entirely outside of an outer perimeter of the columns;

a column-to-pontoon connector positioned between the inner perimeter of the buoyant pontoon and each buoyant column of the plurality of buoyant columns; and a topside attached to and supported at tops of the plurality of buoyant columns.

* * * * *